US011104145B2

(12) United States Patent
Zhang et al.

(10) Patent No.: US 11,104,145 B2
(45) Date of Patent: Aug. 31, 2021

(54) REMAN INK CARTRIDGE, REMAN CHIP AND PRINTER SYSTEM COMMUNICATION METHOD

(71) Applicant: HANGZHOU CHIPJET TECHNOLOGY CO., LTD, Hangzhou (CN)

(72) Inventors: Heng Zhang, Hangzhou (CN); Ming Kong, Hangzhou (CN)

(73) Assignee: HANGZHOU CHIPJET TECHNOLOGY CO., LTD., Hangzhou (CN)

( * ) Notice: Subject to any disclaimer, the term of this patent is extended or adjusted under 35 U.S.C. 154(b) by 0 days.

(21) Appl. No.: 16/076,934

(22) PCT Filed: Mar. 2, 2016

(86) PCT No.: PCT/CN2016/075272

§ 371 (c)(1),
(2) Date: Aug. 9, 2018

(87) PCT Pub. No.: WO2017/147795

PCT Pub. Date: Sep. 8, 2017

(65) Prior Publication Data

US 2019/0047292 A1 Feb. 14, 2019

(51) Int. Cl.
*B41J 2/175* (2006.01)

(52) U.S. Cl.
CPC ..... *B41J 2/17546* (2013.01); *B41J 2/1753* (2013.01); *B41J 2/17526* (2013.01)

(58) Field of Classification Search
CPC .. B41J 2/17546; B41J 2/17526; B41J 2/1753; B41J 2/17543; B41J 2/14072; B41J 2/04508; B41J 2202/17; B41J 2202/18
See application file for complete search history.

(56) References Cited

U.S. PATENT DOCUMENTS 5,926,201 A * 7/1999 Fleming et al. ..... 347/13
6,000,773 A * 12/1999 Murray et al. ..... 347/19

FOREIGN PATENT DOCUMENTS

CN 101337464 1/2009
CN 103072380 5/2013
(Continued)

OTHER PUBLICATIONS

International search report dated Sep. 8, 2017 of PCT/CN2016/075272.
Written Opinions dated Sep. 8, 2017 of PCT/CN2016/075272.

*Primary Examiner* — Juanita D Jackson

(74) *Attorney, Agent, or Firm* — Dragon Sun Law Firm, PC; Jinggao Li, Esq.

(57) ABSTRACT

The present disclosure relates to the field of printers, and in particular to a reman ink cartridge, a reman chip, a printer system communication method, and an ink cartridge regeneration method. The reman ink cartridge is used for solving the technical problem that ink cartridges of different series cannot be recycled in the prior art, comprises an ink cartridge body provided with an original chip corresponding to a printer of a first model, and the reman chip and is characterized in that the structure of the ink cartridge body is matched with that of a printer of a second model, the reman chip is electrically connected with the original chip, makes the reman ink cartridge be matched with the printer of the second model, and at least makes the reman ink cartridge communicate with the printer of the second model.

6 Claims, 11 Drawing Sheets

(56) References Cited

FOREIGN PATENT DOCUMENTS

| | | |
|---|---|---|
| CN | 203401815 | 1/2014 |
| CN | 105216452 | 1/2016 |
| CN | 105538916 | 5/2016 |
| CN | 205467927 | 8/2016 |
| JP | 2004098564 | 4/2004 |

* cited by examiner

REMAN INK CARTRIDGE, REMAN CHIP AND PRINTER SYSTEM COMMUNICATION METHOD

CROSS-REFERENCE TO RELATED APPLICATION

This applicant is a national stage application of PCT/CN2016/075272, filed on Mar. 2, 2016, the content of which is incorporated herein in the entirety by reference.

TECHNICAL FIELD

The present disclosure relates to the field of printers, and in particular to a reman ink cartridge, a reman chip, a printer system communication method and an ink cartridge regeneration method.

BACKGROUND ART

With the enhancement of the environmental consciousness of people and the higher and higher requirements for cyclic utilization of resources, the utilization rate of reman chips for ink cartridges on the market is greatly increased, more and more discarded ink cartridges are used repeatedly, and pollution to the environment is reduced.

Different series and models of ink cartridges exist on the existing market, and if chips of two ink cartridges are inconsistent with pads of a printer, the two ink cartridges are of different series. The same series of ink cartridges with identical printer pads can also be of different models, however, the appearances, chips and contact points with printers of the same series of ink cartridges of different models are identical. Since the appearances, chips and contact points with printers of ink cartridges of different series are different, communication protocols between ink cartridges of different series and printers can also be different. Therefore, reman ink cartridges on the existing market are reman generally for ink cartridges of the same series or the same model. However, since the market shares of ink cartridges of different series or different models are different, the prices, quantities and reman market shares of recycled ink cartridges are different. For discarded ink cartridges of certain series, the recycling price is high, the quantity is small, and consequentially, requirements of the reman market cannot be well met; for discarded ink cartridges of other series, the recycling price is high, the quantity is large, however, the market requirement is low. Consequentially, unbalance between supply and demand of the ink cartridge recycling market is caused, and recycling of ink cartridges is impeded.

SUMMARY OF THE PRESENT DISCLOSURE

For solving the technical problem that in the prior art, recycling of different series of ink cartridges cannot be achieved, the present disclosure provides a reman ink cartridge comprising an ink cartridge body provided with an original chip, and a reman chip, and the original chip corresponds to a printer of a first model; the reman ink cartridge is characterized in that the structure of the ink cartridge body is matched with that of a printer of a second model, the reman chip is electrically connected with the original chip and makes the reman ink cartridge be matched with the printer of the second model, and the reman chip at least makes the reman ink cartridge be in communication with the printer of the second model.

Furthermore, the original chip comprises original chip pads electrically connected with the printer of the first model; the reman chip comprises second pads, first pads and a conversion circuit electrically connected with the second pads and the first pads; the second pads are used for being electrically connected with the printer of the second model, the first pads are electrically connected with the original chip pads, and the conversion circuit can receive and convert electric signals from the second pads and the first pads to make the reman ink cartridge pass authentication detection of the printer of the second model and respond to control of the printer of the second model.

Furthermore, the conversion circuit comprises a data modification unit or a data replacement unit; the data modification unit is used for modifying ink quantity data and ink cartridge model data stored in the original chip to make the reman ink cartridge pass authentication of the printer of the second model, and the data modification unit is electrically connected with the second pads and also electrically connected with the first pads; the data replacement unit is used for replacing the ink quantity data and ink cartridge model data stored in the original chip to make reman ink cartridge pass authentication of the printer of the second model, and the data replacement unit is electrically connected with the second pads.

Furthermore, the conversion circuit comprises a nozzle signal conversion unit, and the nozzle signal conversion unit is electrically connected with the second pads and also electrically connected with the first pads; the nozzle signal conversion unit receives a nozzle control signal, from the second pads, of the printer of the second model, converts the nozzle control signal of the printer of the second model into a corresponding nozzle control signal, according to the nozzle control rule of the printer of the first model, of the printer of the first model and outputs the nozzle control signal of the printer of the first model through the first pads.

Furthermore, the conversion circuit comprises an electric parameter adjustment unit which is used for adjusting the electric parameter of the original chip to make the reman ink cartridge pass electric parameter detection of the printer of the second model, and the electric parameter adjustment circuit is electrically connected with the first pads.

Furthermore, the conversion circuit comprises a logic conversion unit which makes the reman ink cartridge to pass logic detection of the printer of the second model, and the logic conversion unit is electrically connected with the second pads and also electrically connected with the first pads.

Furthermore, the logic conversion unit comprises a detection signal logic operation module and a feedback signal logic operation module; the logic conversion unit receives a logic detection signal, from the second pads, of the printer of the second model, converts the logic detection signal of the printer of the second model into a corresponding logic detection signal, according to the logic detection rule of the printer of the first model, of the printer of the first model through the detection signal logic operation module and outputs the logic detection signal of the printer of the first model through the first pads; the logic detection unit receives a logic detection feedback signal, from the first pads, of the printer of the first model, converts the logic detection feedback signal of the printer of the first model into a corresponding logic detection feedback signal, according to the logic detection rule of the printer of the second model, of the printer of the second model through the feedback signal logic operation module and outputs the logic detection feedback signal of the printer of the second model through the second pads.

Furthermore, the reman chip is provided with a substrate used for carrying the conversion circuit, and an adhesive film layer fixedly connected with the ink cartridge body is arranged on one side of the substrate.

Furthermore, the substrate is provided with positioning holes used for positioning the ink cartridge body.

Furthermore, the substrate is provided with test pads, and the test pads are electrically connected with the conversion circuit.

The present disclosure further provides a reman chip which is used for regenerating a reman ink cartridge matched with a printer of a second model from an original ink cartridge matched with a printer of a first model; the reman chip comprises second pads, first pads and a conversion circuit which is electrically connected with the second pads and the first pads; the reman chip is characterized in that the second pads are used for being electrically connected with the printer of the second model, the first pads are used for being electrically connected with an original chip of the original ink cartridge, and the conversion circuit receives electric signals from the second pads and the first pads to make the reman ink cartridge pass authentication detection of the printer of the second model and respond to control of the printer of the second model.

Furthermore, the conversion circuit comprises a data modification unit or a data replacement unit; the data modification unit is used for modifying ink quantity data and ink cartridge model data stored in the original chip to make the reman ink cartridge pass authentication of the printer of the second model, and the data modification unit is electrically connected with the second pads and also electrically connected with the first pads; the data replacement unit is used for replacing the ink quantity data and ink cartridge model data stored in the original chip to make reman ink cartridge pass authentication of the printer of the second model, and the data replacement unit is electrically connected with the second pads.

Furthermore, the conversion circuit comprises a nozzle signal conversion unit, and the nozzle signal conversion unit is electrically connected with the second pads and also electrically connected with the first pads; the nozzle signal conversion unit receives a nozzle control signal, from the second pads, of the printer of the second model, converts the nozzle control signal of the printer of the second model into a corresponding nozzle control signal, according to the nozzle control rule of the printer of the first model, of the printer of the first model and outputs the nozzle control signal of the printer of the first model through the first pads.

Furthermore, the conversion circuit comprises an electric parameter adjustment unit which is used for adjusting the electric parameter of the original chip to make the reman ink cartridge pass electric parameter detection of the printer of the second model, and the electric parameter adjustment circuit is electrically connected with the first pads.

Furthermore, the conversion circuit comprises a logic conversion unit which makes the reman ink cartridge to pass logic detection of the printer of the second model, and the logic conversion unit is electrically connected with the second pads and also electrically connected with the first pads.

Furthermore, the logic conversion unit comprises a detection signal logic operation module and a feedback signal logic operation module; the logic conversion unit receives a logic detection signal, from the second pads, of the printer of the second model, converts the logic detection signal of the printer of the second model into a corresponding logic detection signal, according to the logic detection rule of the printer of the first model, of the printer of the first model through the detection signal logic operation module and outputs the logic detection signal of the printer of the first model through the first pads; the logic conversion unit receives a logic detection feedback signal, from the first pads, of the printer of the first model, converts the logic detection feedback signal of the printer of the first model into a corresponding logic detection feedback signal, according to the logic detection rule of the printer of the second model, of the printer of the second model through the feedback signal logic operation module and outputs the logic detection feedback signal of the printer of the second model through the second pads.

Furthermore, the reman chip is provided with a substrate used for carrying the conversion circuit, and an adhesive film layer fixedly connected with the ink cartridge body is arranged on one side of the substrate.

Furthermore, the substrate is provided with positioning holes used for positioning the ink cartridge body.

Furthermore, the substrate is provided with test pads, and the test pads are electrically connected with the conversion circuit.

The present disclosure further provides a printer system communication method which is suitable for a printer system comprising a printer of a second model and a reman ink cartridge, wherein the reman ink cartridge comprises an original chip matched with a printer of a first model, and a reman chip, the printer of the second model is electrically connected with the reman chip, and the original chip is electrically connected with the reman chip; the reman chip receives and converts electric signals from the printer of the second model and the original chip to make the reman ink cartridge pass authentication detection of the printer of the second model and respond to control of the printer of the second model; the printer system communication method is characterized in that the reman chip is used for modifying or replacing ink quantity data and ink cartridge model data stored in the original chip to make the ink quantity data in the reman ink cartridge be non-ink-out data, and the ink cartridge model data of the reman ink cartridge are matched with those of the printer of the second model; wherein, the non-ink-out data indicate that the residual ink quantity of the ink cartridge is larger than the smallest ink quantity data allowed by the printer.

Furthermore, the reman chip receives a nozzle control signal, from the printer of the second model, of the printer of the second model, converts the nozzle control signal of the printer of the second model into a corresponding nozzle control signal, according to the nozzle control rule of the printer of the first model, of the printer of the first model and sends the nozzle control signal of the printer of the first model to the original chip.

Furthermore, the reman chip receives a logic detection signal, from the printer of the second model, of the printer of the second model, converts the logic detection signal of the printer of the second model into a corresponding logic detection signal, according to the logic detection rule of the printer of the first model, of the printer of the first model, and sends the logic detection signal of the printer of the first model to the original chip; the reman chip receives a logic detection feedback signal, from the original chip, of the printer of the first model, converts the logic detection feedback signal of the printer of the first model into a corresponding logic detection feedback signal, according to the logic detection rule of the printer of the second model, of the printer of the second model and sends the logic detection feedback signal of the printer of the second model to the printer of the second model.

The present disclosure further provides an ink cartridge regeneration method which is used for regenerating a target ink cartridge matched with a printer of a second model from an original ink cartridge matched with a printer of a first model, and the ink cartridge regeneration method is characterized by comprising the following steps of structure adjustment of the ink cartridge, specifically, the ink cartridge size and nozzle position of the original ink cartridge are adjusted to be consistent with those of the target ink cartridge; filling of the ink cartridge, specifically, an ink bin of the original ink cartridge body is filled with ink; chip adjustment of the ink cartridge, specifically, chip pads of the original ink cartridge are adjusted to be consistent with those of the target ink cartridge.

Furthermore, structure adjustment of the ink cartridge comprises the step of size adjustment of the ink cartridge, specifically, the ink cartridge size of the original ink cartridge is adjusted through the cutting and/or connecting technique to be the same as the ink cartridge size of the target ink cartridge.

Furthermore, structure adjustment of the ink cartridge comprises the step of nozzle position adjustment, specifically, the nozzle position of the original ink cartridge is adjusted through the filling technique to be the same as the nozzle position of the target ink cartridge or the original ink cartridge is positioned through a clamp and the original ink cartridge is ground and cut or complemented, so that the nozzle position of the original ink cartridge is made to be the same as the nozzle position of the target ink cartridge.

Furthermore, chip adjustment of the ink cartridge comprises the steps of:

(a) cleaning of pads, specifically, stains and oxide layers on the surfaces of the chip pads of the original ink cartridge are removed; and (b) chip attaching, specifically, the reman chip is attached to the original ink cartridge, so that first pads of the reman chip are made to make contact with the chip pads of the original ink cartridge.

Furthermore, chip adjustment of the ink cartridge further comprises the step of:

c) welding, specifically, the reman chip and the chip of the original ink cartridge are welded, so that the first pads of the reman chip are made to be electrically connected with the chip pads of the original ink cartridge.

Target ink cartridges which are small in recycling quantity and low in price on the ink cartridge regeneration market and correspond to the printer of the second model are regenerated from original ink cartridges which are large in recycling quantity and low in price on the ink cartridge regeneration market and correspond to the printer of the first model through the ink cartridge regeneration method; the ink cartridge regeneration method comprises the steps that the structure of an original ink cartridge is adjusted so that a target ink cartridge formed after regeneration can be mounted in the printer of the second model; in addition, the reman chip is mounted on the original ink cartridge, and pads of the target ink cartridge formed after regeneration can be matched with the printer of the second model by adjusting the chip of the original ink cartridge. Adjustment of the original ink cartridge by the reman chip includes:

1. contact adjustment of the original chip, specifically, the first pads of the reman chip correspond to the original chip, the second pads of the reman chip correspond to the printer of the second model, and thus the target ink cartridge can be in communication with the printer of the second model through the pads of the target ink cartridge.

2. data adjustment of the original chip, specifically, the data modification unit or the data replacement unit can achieve modification or replacement of the ink quantity data and the ink cartridge model data of the original ink cartridge so that the target ink cartridge can pass authentication detection of the printer of the second model.

3. nozzle signal conversion, specifically, since the printer of the first model and the printer of the second model are of different models, communication protocols and rules formed by data of the printer of the first model and the printer of the second model can also be different; the reman chip is used for converting a nozzle control signal, from the printer of the second model, of the printer of the second model so that the original chip can correctly recognize the nozzle control signal from the printer of the second model.

4. electric parameter adjustment of the original chip, specifically, the reman chip can also adjust the circuit of the original chip so that the target ink cartridge can pass contact detection of the printer of the second model.

5. logic signal conversion, specifically, since the printer of the first model and the printer of the second model are of different models, operation rules for logic detection of the printer of the first model and the printer of the second model can also be different; the reman chip receives a logic detection signal, from the printer of the second model, of the printer of the second model and a logic detection feedback signal from the original chip and converts the signals so that the target ink cartridge can pass logic detection of the printer of the second model.

Through the ink cartridge regeneration method, the target ink cartridge can be controlled by the printer of the second model, and printing work is achieved.

The present disclosure has the following beneficial effects that:

1. the recycling barrier of different series of ink cartridges on the ink cartridge recycling market is broken through, and the recycling cost of ink cartridges is reduced;

2. converting utilization of ink cartridges of different series/models is achieved in the ink cartridge recycling process, and the utilization rate of ink cartridges is increased;

3. through conversion between ink cartridges of different series, the regeneration requirement for different series of ink cartridges on the regeneration market can be met according to requirements;

4. the reman chip is simple in structure and easy and convenient to mount, and the production cost for recycling ink cartridges is reduced;

5. through the reman chip, connection, matching, electric parameter adjustment and data format conversion between the original ink cartridge and the target ink cartridge are achieved at a time, and operation is easy; and 6. after being put onto the market, the reman ink cartridge can be recycled again and ink cartridges of any series or any model can be regenerated from the reman ink cartridge.

Wherein, 1—substrate, 11—first contact, 12—second contact, 13—conversion circuit, 14—positioning hole, 15—test contact

DETAILED DESCRIPTION OF THE PRESENT DISCLOSURE

A detailed description of embodiments of the present disclosure is given as follows with accompanying drawings. The technical scheme is based on the basic principle that communication commands between different series are approximately identical, and effective communication between printers and ink cartridges can be achieved through adjustment of reman chips.

First Embodiment

Figure 2:
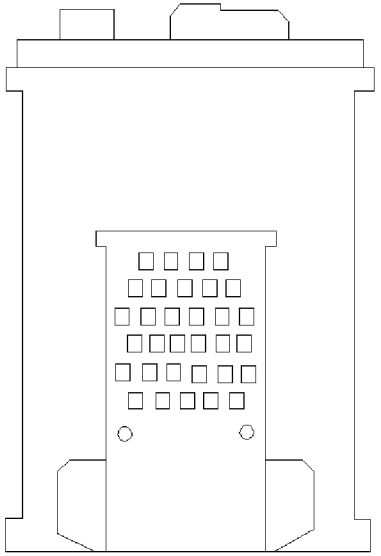
FIG. 2 is a schematic diagram of an ink cartridge B and pads of the ink cartridge B.
Figure 1:
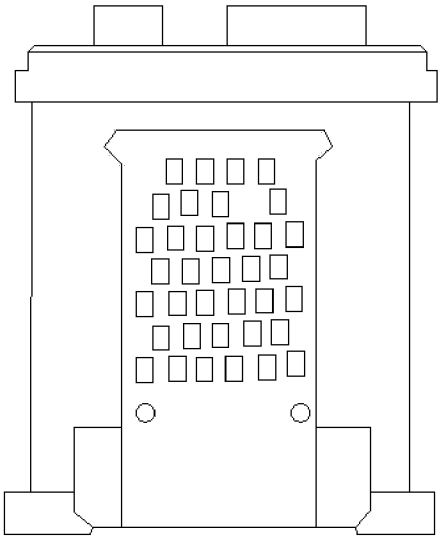
FIG. 1 is a schematic diagram of an ink cartridge A and pads of the ink cartridge A.

An ink cartridge A and an ink cartridge B are two ink cartridges of different series, wherein the ink cartridge A corresponds to a printer of a first model, and the ink cartridge B corresponds to a printer of a second model. The ink cartridge A and the ink cartridge B are in communication with the corresponding printers through pads of the ink cartridge A and the ink cartridge B and cooperate with the printers to complete printing operation. The pads of the ink cartridges include pads ADDR connected with address lines (ADDR) of the printers, pads CLK connected with clock lines (CLK) of the printers, pads LOAD connected with enable lines (LOAD) of the printers, pads Pt_Ctrl connected with control lines (Pt_Ctrl) of the printers, and the like. In the embodiment, the pads and the outline structure of the ink cartridge A are shown in FIG. 1, the pads and outline structure of the ink cartridge B are shown in FIG. 2, and the outline structure, the contact number and the contact distribution of the ink cartridge A are all different from those of the ink cartridge B.

A reman ink cartridge (namely a target ink cartridge) matched with the printer of the second model is regenerated from the ink cartridge A (namely an original ink cartridge) recycled from the market, and the reman ink cartridge can be used in cooperation with the printer of the second model to complete printing operation. The outline structure of the reman ink cartridge should be similar to that of the ink cartridge B so that the reman ink cartridge can be mounted in the printer of the second model; the contact number, the contact distribution and the contact positions of the reman ink cartridge should be the same as those of the second ink cartridge B so that the pads of the reman ink cartridge can be electrically connected with pads of the printer of the second model, and a physical basis is provided for communication between the reman ink cartridge and the printer of the second model; furthermore, the reman ink cartridge should be capable of communicating with the printer of the second model to complete corresponding printing operation.

Therefore, the operation for converting the ink cartridge A which is recycled from the recycling market and corresponds to the printer of the first model into the target ink cartridge which corresponds to the printer of the second model comprises the following three aspects:

1. structure adjustment of the ink cartridge, specifically, the ink cartridge size and nozzle position of the ink cartridge A are adjusted to be consistent with those of the target ink cartridge; structure adjustment of the ink cartridge specifically comprises the steps of size adjustment of the ink cartridge, specifically, the ink cartridge size of the ink cartridge A is adjusted through the cutting and/or connecting technique to be the same as the ink cartridge size of the target ink cartridge; nozzle position adjustment, specifically, the nozzle position of the ink cartridge A is adjusted through the filling technique to be the same as the nozzle position of the target ink cartridge or the ink cartridge A is positioned through a clamp and the ink cartridge A is ground and cut or complemented, so that the nozzle position of the ink cartridge A is made to be the same as the nozzle position of the target ink cartridge.

2. filling of the ink cartridge, specifically, an ink bin of the ink cartridge A is filled with ink; filling of the ink cartridge specifically comprises the step of cleaning the ink bin of the ink cartridge A and filling the ink bin of the ink cartridge A with corresponding ink.

3. chip adjustment of the ink cartridge, specifically, chip pads of the ink cartridge A are adjusted to be consistent with those of the target ink cartridge; chip adjustment of the ink cartridge specifically comprises the steps of:

a) cleaning of pads, specifically, stains and oxide layers on the surfaces of the chip pads of the ink cartridge A are removed;

b) chip attaching, specifically, the reman chip is attached to the ink cartridge A, so that first pads of the reman chip are made to make contact with the chip pads of the ink cartridge A.

c) welding, specifically, the reman chip and the chip of the ink cartridge A are welded, so that the first pads of the reman chip are made to be electrically connected with the chip pads of the ink cartridge A.

The method for regenerating the ink cartridge A specifically comprises:

the first step of detecting the recycled ink cartridge A through a printer or equipment to determine whether the ink cartridge A is recyclable or not;

the second step of adjusting the nozzle position to make the nozzle position of the ink cartridge A identical with the nozzle position of the target ink cartridge;

the third step of protecting a nozzle, specifically, a protective film is attached to the nozzle of the ink cartridge A;

the fourth step of uncapping, specifically, a top cap of the ink cartridge A is taken out, and the top cap can be pried up through an art knife after being simply soaked in alcohol for two seconds;

the fifth step of removing sponge, specifically, the sponge inside the ink bin of the ink cartridge A is taken out so that ink can be prevented from splashing around in the cutting process;

the sixth step of cutting the ink cartridge, specifically, the part, higher than the target ink cartridge, of the ink cartridge A is cut away;

the seventh step of filling with ink, specifically, the ink bin of the ink cartridge A is filled with ink again;

the eighth step of closing the top cap, specifically, the ink cartridge A is sealed with the top cap again through adhesives;

the ninth step of cleaning the pads, specifically, the surfaces of the chip pads of the ink cartridge A can be wiped with alcohol and the like, so that stains and oxide layers on the surfaces of the chip pads are removed;

the tenth step of attaching the chip, specifically, an adhesive film layer on the back side of the reman chip is exposed, then the four positioning holes of the reman chip are aligned to four positioning columns of the ink cartridge A, and afterwards, the reman chip is attached to the ink cartridge A; the reman chip needs to be compacted again after being attached to the ink cartridge A, and thus a double faced adhesive tape of the adhesive film layer is prevented from stripping.

the eleventh step of testing through a detector, specifically, the ink cartridge A attached with the reman chip is placed in the ink cartridge detector to be tested, and welding can be conducted only under the condition that the testing result is OK, or the ink cartridge A can be directly tested on the printer;

the twentieth step of welding, specifically, all the pads of the reman chip are welded through a welding head, the temperature of the welding head is set to 200 DEG C., and the welding time of each single contact is no longer than 3 seconds, so that the phenomenon that too much soldering tin flows into adjacent pads, and consequentially short circuits are caused and the pads are not compatible with the printer is prevented;

the thirteenth step of mounting the ink cartridge completed in the twentieth step on the printer of the second model so as to be tested on the printer, specifically, if the ink cartridge pass testing on the printer, it indicates that the process of regenerating the reman ink cartridge corresponding to the printer of the second model from the ink cartridge A is completed, and regeneration of the ink cartridge succeeds; the reman ink cartridge can be mounted in the printer of the second model like an ink cartridge B and can cooperate with the printer of the second model to complete normal printing and other operation.

The reman chip comprises a substrate 1 which is used for carrying a conversion circuit 13, first pads 11 arranged on the front side of the substrate, and second pads 12 arranged on the back side of the substrate. The substrate 1 further comprises an adhesive film layer, positioning holes 14 and test pads 15, wherein the adhesive film layer is arranged on the front side of the substrate 1 and used for bonding the substrate on the ink cartridge A so as to make the reman chip be fixedly connected with the ink cartridge A; the positioning holes 14 can be matched with positioning columns on the ink cartridge A to position the reman chip, so that the first pads arranged on the front side of the reman chip make contact with the chip pads of the ink cartridge A in a one-to-one corresponding mode. The test pads 15 are electrically connected with the conversion circuit 13 and used for program recording or testing of the reman chip.

Figure 4:
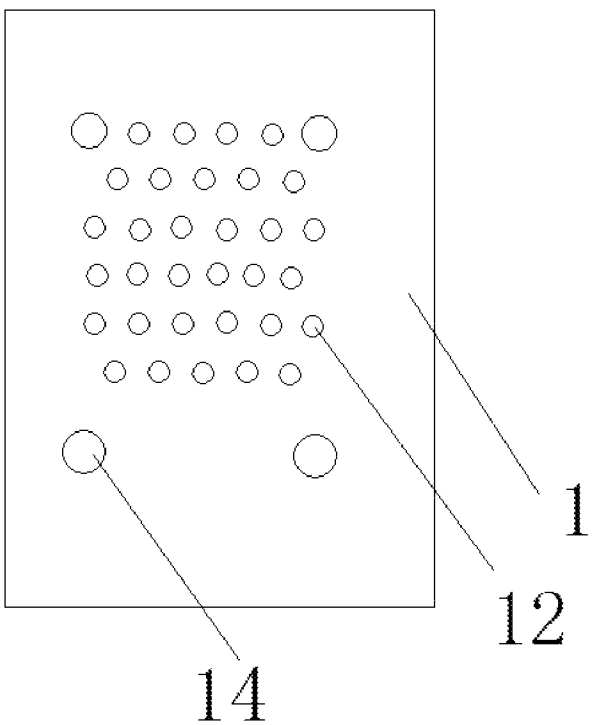
FIG. 4 is a schematic diagram of the back side of the reman chip.
Figure 3:
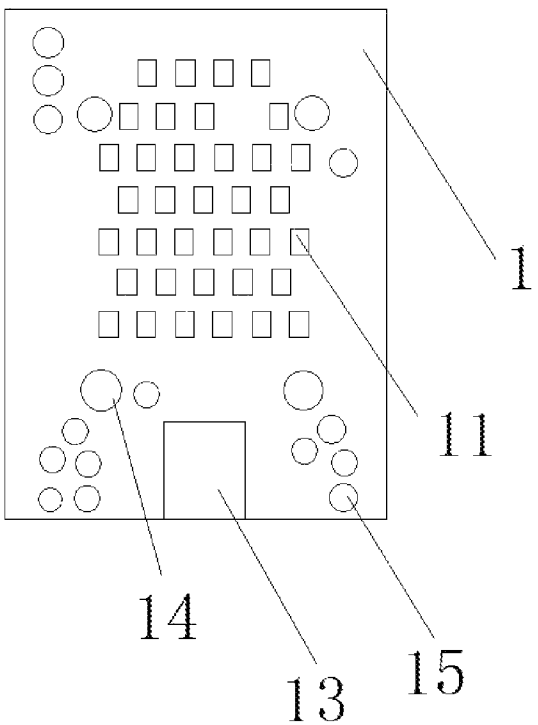
FIG. 3 is a schematic diagram of the front side of a reman chip.

FIG. 3 and FIG. 4 show the structure schematic diagrams of the front side and the back side of the reman chip of the reman ink cartridge which is regenerated from the ink cartridge A recycled from the market and matched with the printer of the second model respectively. The number and arrangement of the first pads 11 are the same as those of the chip pads of the ink cartridge A, and the first pads 11 are used for being electrically connected with the chip pads of the ink cartridge A, can receive an electric signal from the chip of the ink cartridge A and can also send an electric signal to the chip of the ink cartridge A. The number and arrangement of the second pads 12 are the same as those of the chip pads of the ink cartridge B, and the second pads 12 are used for being electrically connected with the printer of the second model, can receive an electric signal from the printer of the second model and can also send an electric signal to the printer of the second model. The conversion circuit 13 receives and converts electric signals from the second pads 12 and the first pads 11 to make the reman ink cartridge pass authentication detection of the printer of the second model and respond to control of the printer of the second model.

Figure 5:
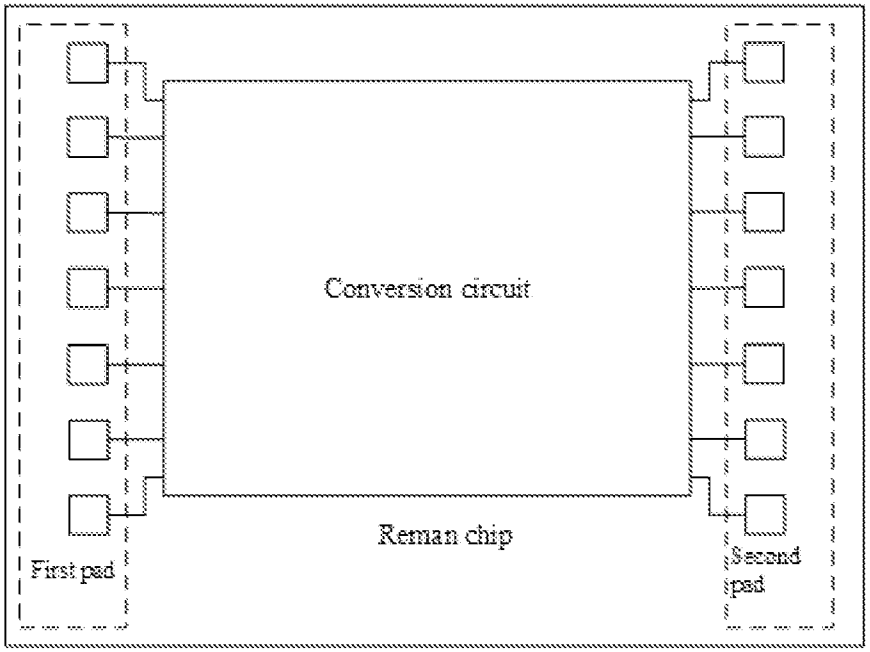
FIG. 5 is a structure schematic diagram of the reman chip.

As is shown in FIG. 5, the conversion circuit is electrically connected with the first pads and also electrically connected with the second pads. For converting the ink cartridge A into the target ink cartridge, the reman chip needs to provide the physical basis for communication between the reman ink cartridge and the printer of the second model and also needs to transform the chip of the ink cartridge A according to the difference between the ink cartridge A and the target ink cartridge and to convert data output by the printer of the second model and the ink cartridge A, so that control over the reman ink cartridge by the printer of the second model is achieved, and the reman ink cartridge can be controlled by the printer of the second model to complete printing operation. Therefore, the conversion circuit 13 of the reman chip further specifically comprises a data modification unit, a nozzle signal conversion unit, an electric parameter adjustment unit and a logic conversion unit.

1) Data Modification Unit

Figure 6:
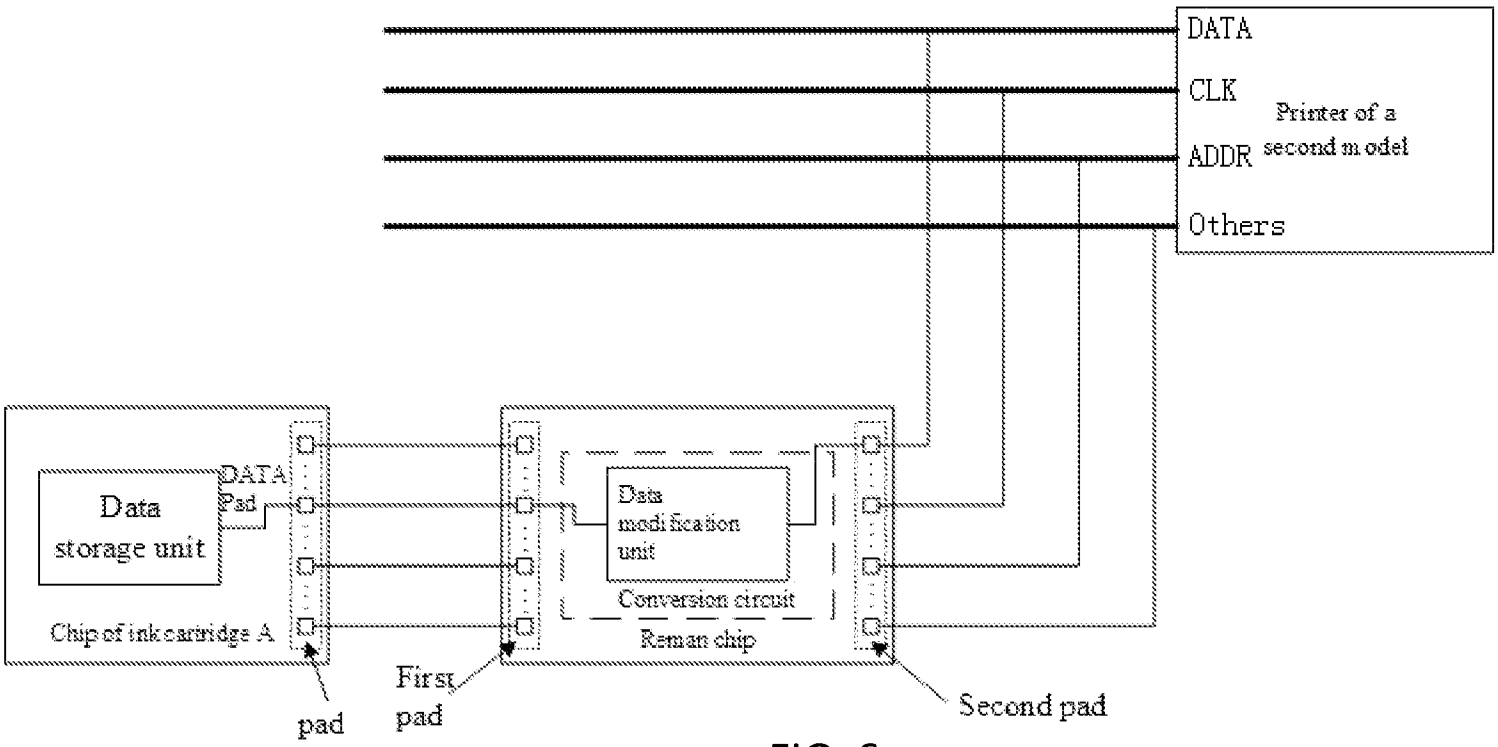
FIG. 6 is connection schematic diagram of a data modification unit.

FIG. 6 is a connection schematic diagram of the data modification unit. Data communication is the most basic condition for the ink cartridge to pass authentication of the printer, data content includes ink quantity data indicating the residual ink quantity of the ink cartridge, the ink cartridge model and other content. A data storage unit of the ink cartridge A adopts an irreversible memory such as a fuse wire memory. The residual ink quantity is decreased gradually in the using process of the ink cartridge and cannot be restored, and the ink cartridge cannot be used any more after ink in the ink cartridge is used up. For recycling the ink cartridge, the reman chip is needed for repairing the ink quantity of the ink cartridge. The data storage unit of the ink cartridge A also stores the ink cartridge model data besides the ink quantity data, namely printers of different models correspondingly adopt ink cartridges of different models, for example, the ink cartridge of the model A can only be suitable for the printer of the model A and cannot be applied to printers of other models even though other characteristics (communication, control, detection and the like) of the printers are consistent with those of the ink cartridge A. On this basis, in the process of regenerating the target ink cartridge from the ink cartridge A, the ink cartridge model data stored in the chip of the ink cartridge A need to be modified. However, since the ink cartridge model data are stored in the irreversible storage unit of the ink cartridge A, the ink cartridge model data cannot be modified directly. For this reason, the data modification unit of the reman chip is needed for modifying the ink cartridge model data. The data modification unit of the reman chip is electrically connected with the first pads and the second pads so as to rewrite the ink quantity data and the ink cartridge model data stored in the chip of the ink cartridge A, and thus the reman ink cartridge can pass authentication of the printer of the second model.

2) Nozzle Signal Conversion Unit

Figure 7:
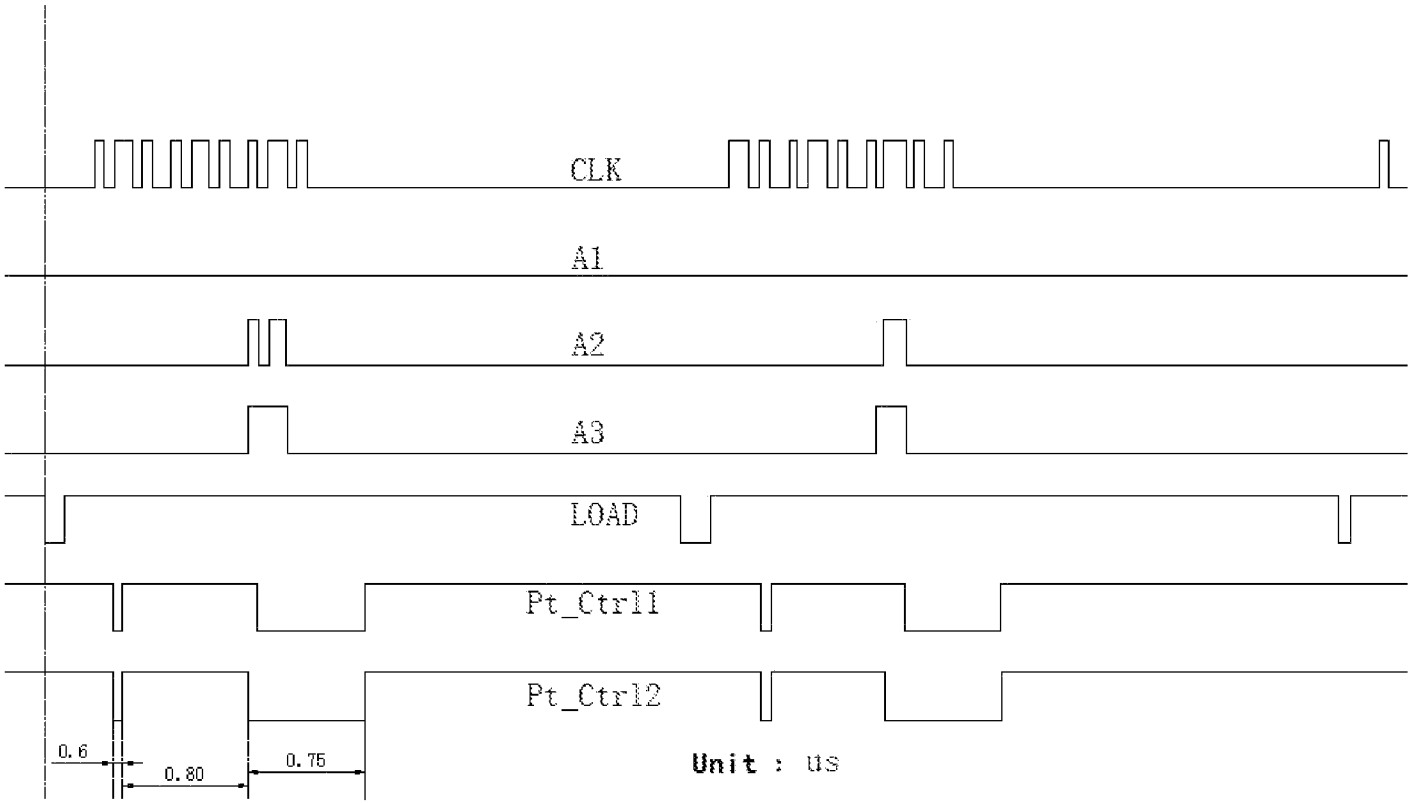
FIG. 7 is a sequence diagram of a nozzle control signal of a printer of a first model.

FIG. 7 is a sequence diagram of a nozzle control signal of a printer of a first model. The printer of the first model is provided with three address lines, namely ADDR1, ADDR2 and ADDR3, and the three address lines respectively and correspondingly control selection of nozzle addresses C, M and Y of the ink cartridge A. The printer of the first model selects a nozzle point according to the command combination of a CLK line, a LOAD line and the ADDR lines. After one nozzle point is selected, electric signals on two control lines, namely Pt_Ctrl1 and Pt_Ctrl2, are pulled down at the same time before the next clock period, and a nozzle on the ink cartridge A is controlled to spray ink.

Figure 8:
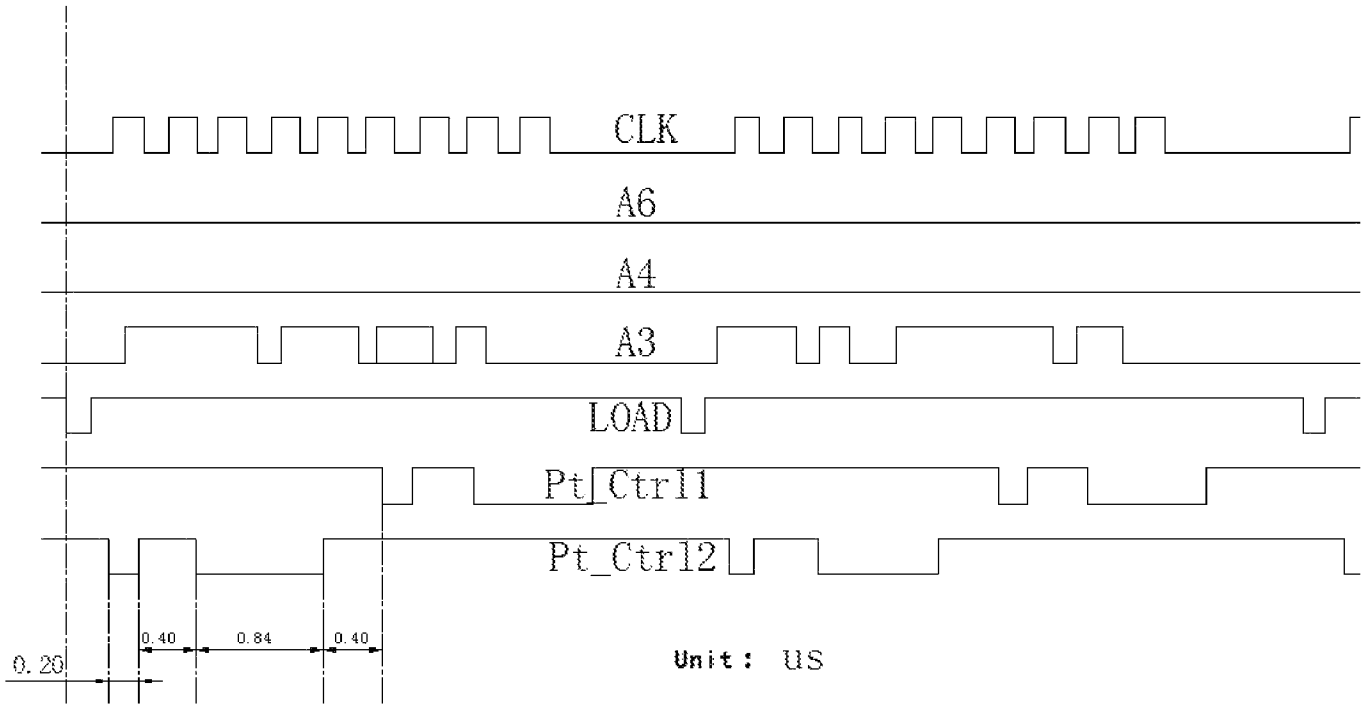
FIG. 8 is a sequence diagram of a nozzle control signal of a printer of a second model.

FIG. 8 is a sequence diagram of a nozzle control signal of a printer of a second model. The printer of the second model is totally provided with six address lines, wherein the address line ADDR3, the address line ADDR4 and the address line ADDR6 correspond to the color C, the color M and the color Y respectively, and the other address lines do not directly participate in printing. Similarly, the printer of the second model controls a nozzle of the ink cartridge B to spray ink by pulling down electric signals on the control lines, namely Pt_Ctrl1 and Pt_Ctrl2. The pull-down duration of the control line Pt_Ctrl1 is consistent with that of the control line Pt_Ctrl2 on the whole, but the pull-down times of the control line Pt_Ctrl1 and the control line Pt_Ctrl2 are different. The electric signal of the control line Pt_Ctrl2 is pulled down 0.4 μs after the electric signal on the control line Pt_Ctrl1 is pulled down.

It can be known from the above analysis that the difference between the nozzle control signal of the printer of the first model and the nozzle control signal of the printer of the second model mainly lies the time sequence of the control line Pt_Ctrl1 and the control line Pt_Ctrl2; pulling-down of the electric signals on the control line Pt_Ctrl1 and the control line Pt_Ctrl2 of the printer of the first model is started at the same time and ended at the same time, first-time pulling-down lasts for 0.6 μs, second-time pulling-down lasts for 0.75 μs, and the time interval is 0.8 μs (please see FIG. 7 for the specific time sequence). Pulling-down of the electric signals on the control line Pt_Ctrl1 and the control line Pt_Ctrl2 of the printer of the second model is started at different times, and pulling-down of the electric signal on the control line Pt_Ctrl2 is started 0.4 μs after pulling-down of the electric signal on the control line Pt_Ctrl1 is ended; in addition, first-time pulling-down lasts for 0.2 μs, second-time pulling-down lasts for 0.84 μs, and the time interval is 0.4 μs (please see FIG. 8 for the specific time sequence).

In addition, the difference can also lie in that the address lines used for selecting nozzle points are different, and commands on the address lines used for selecting the nozzle points are different.

Figure 9:
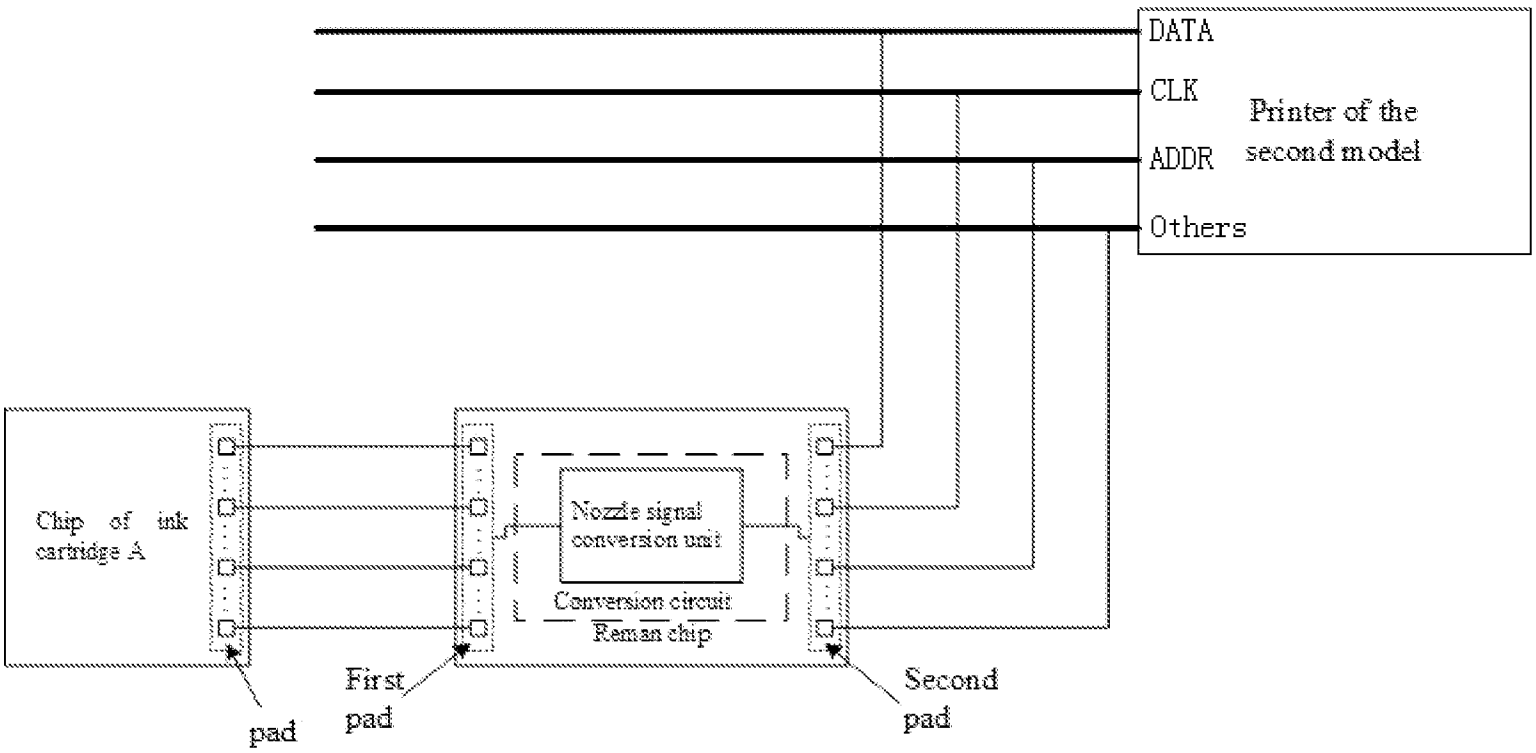
FIG. 9 is a connection schematic diagram of a nozzle signal conversion unit.

The nozzle signal conversion unit of the reman chip receives a nozzle control signal, from the second pads, of the printer of the second model, converts the nozzle control signal of the printer of the second model into a corresponding nozzle control signal, according to the nozzle control rule of the printer of the first model, of the printer of the first model and outputs the nozzle control signal of the printer of the first model to the chip of the ink cartridge A through the first pads. FIG. 9 is a connection schematic diagram of the nozzle signal conversion unit;

the printer of the second model sends the nozzle control signal of the printer of the second model to the reman ink cartridge, and the reman ink cartridge receives the nozzle control signal of the printer of the second model through the second pads of the reman chip and recognizes and determines the nozzle point selected by the printer of the second model through the nozzle signal conversion unit. The nozzle signal conversion unit outputs the nozzle control signal, according to the nozzle control rule of the printer of the first model, of the printer of the first model to the chip of the ink cartridge A through the first pads of the reman chip according to the nozzle point selected by the printer of the second model and based on the nozzle control rule of the printer of the first model, and thus the nozzle point of the ink cartridge A is selected. After the nozzle point is selected, the nozzle signal conversion unit outputs a Pt_Ctrl signal according to the nozzle control rule of the printer of the first model through the first pads of the reman chip according to the nozzle control rule of the printer of the first model so as to control the ink spraying time of the nozzle point of the ink cartridge A.

The nozzle control signals of the printer of the first model and the printer of the second model can also be under the condition that the nozzle point selection commands of the printer of the first model and the printer of the second model are identical, the electric signal pull-down time points of the Pt_Ctrl lines are different, and the electric signal pull-down durations of the Pt_Ctrl lines are slightly different. In actual application, if the control differences between the Pt_Ctrl lines of the printer of the first model and the printer of the second model are within the allowable range, the nozzle control signal, sent out by the printer of the second model, of the printer of the second model can directly act on the chip of the ink cartridge A, and thus the nozzle control signal, from the second pads, of the printer of the second model can be directly output to the chip of the ink cartridge A through the first pads.

The nozzle control signals of the printer of the first model and the printer of the second model can also be under the condition that the numbers of the signal lines Pt_Ctrl are different. Under this condition, the nozzle signal conversion unit can be provided with a special logic data circuit to integrate the multiple control lines Pt_Ctrl electrically connected with the second pads, and then the control lines Pt_Ctrl are combined into the chip of the ink cartridge A through the first pads to achieve control over the nozzle of the ink cartridge A.

3) Electric Parameter Adjustment Unit

Figure 10:
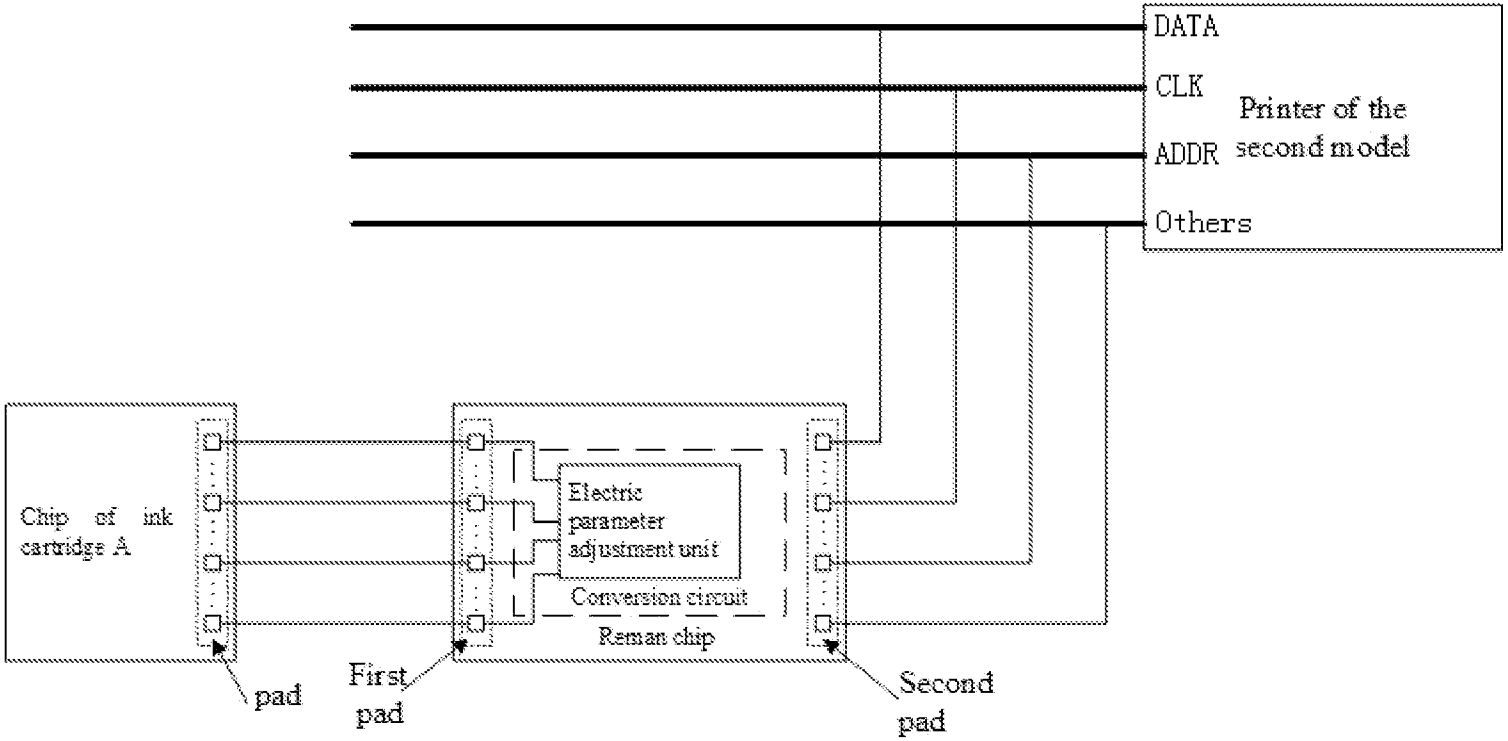
FIG. 10 is a connection schematic diagram of an electric parameter adjustment unit.

The printers can detect electric parameters of the pads of the ink cartridge chips to judge whether short circuits happen to the ink cartridge chips or not, and thus damage to the ink cartridge chips and the printers caused after the ink cartridge chips with short circuits are powered on to work is avoided. Pull-down resistors are designed on all the signal lines, connected with the printer, of the chip of the ink cartridge, and the impedance of the pull-down resistors can protect the chip of the ink cartridge A and the printer electrically connected with the chip of the ink cartridge A under certain specific conditions. Under the short circuit condition of the chip of the ink cartridge A, the impedance of the pull-down resistor can change, and the printer electrically connected with the ink cartridge A can judge the short circuit condition of the chip of the ink cartridge A by detecting the impedance of the pull-down resistors, and thus damage to the printer electrically connected with the chip and the chip caused after the chip of the ink cartridge A is powered on to work is avoided. However, pull-down resistors of ink cartridges of different models are inconsistent or certain chips are not provided with pull-down resistors. Ink cartridges of different types can also be different on the aspects of other electric parameters such as pulling-up of the signal lines, connection between different signal lines (combined connection of diodes, resistors and the like). FIG. 10 is a connection schematic diagram of the electric parameter adjustment unit, and the electric parameter adjustment unit of the reman chip is electrically connected with the chip of the ink cartridge A through the first pads and used for adjusting the electric parameters of the chip of the ink cartridge A to make the reman ink cartridge pass electric parameter detection of the printer of the second model. The electric parameter adjustment unit can adjust the electric parameters, such as the voltage, the current, the impedance and the capacitive reactance, of the chip of the ink cartridge A.

4) Logic Conversion Unit

For detecting whether the circuit logic of the chip of the ink cartridge is normal or not, the printer sends a logic detection command based on the multiple signal lines, logic operation starts to be carried out after the chip of the ink cartridge receives the command, an operation result is obtained finally and fed back to the printer, and the printer judges whether the internal logic of the ink cartridge operates normally or not according to the operation result.

For example, the internal detection logic of the ink cartridge A corresponding to the printer of the first model is based on the formula 1:

However, the internal detection logic of the ink cartridge B corresponding to the printer of the second model is based on the formula 2:

When the reman ink cartridge corresponding to the printer of the second model is generated with the ink cartridge A as the original ink cartridge, the formula 2 is used as the detection standard of the printer of the second model, and the printer of the second model sends a detection command composed of a signal CLK, signals ADDR0-5, a signal LOAD and signals P1-3. However, the chip of the ink cartridge A corresponding to the printer of the first model adopts the formula 1 as the detection standard for logic operation. Therefore, the problem of mismatching can be caused when logic detection is conducted between the chip of the ink cartridge A and the printer of the second model.

Figure 11:
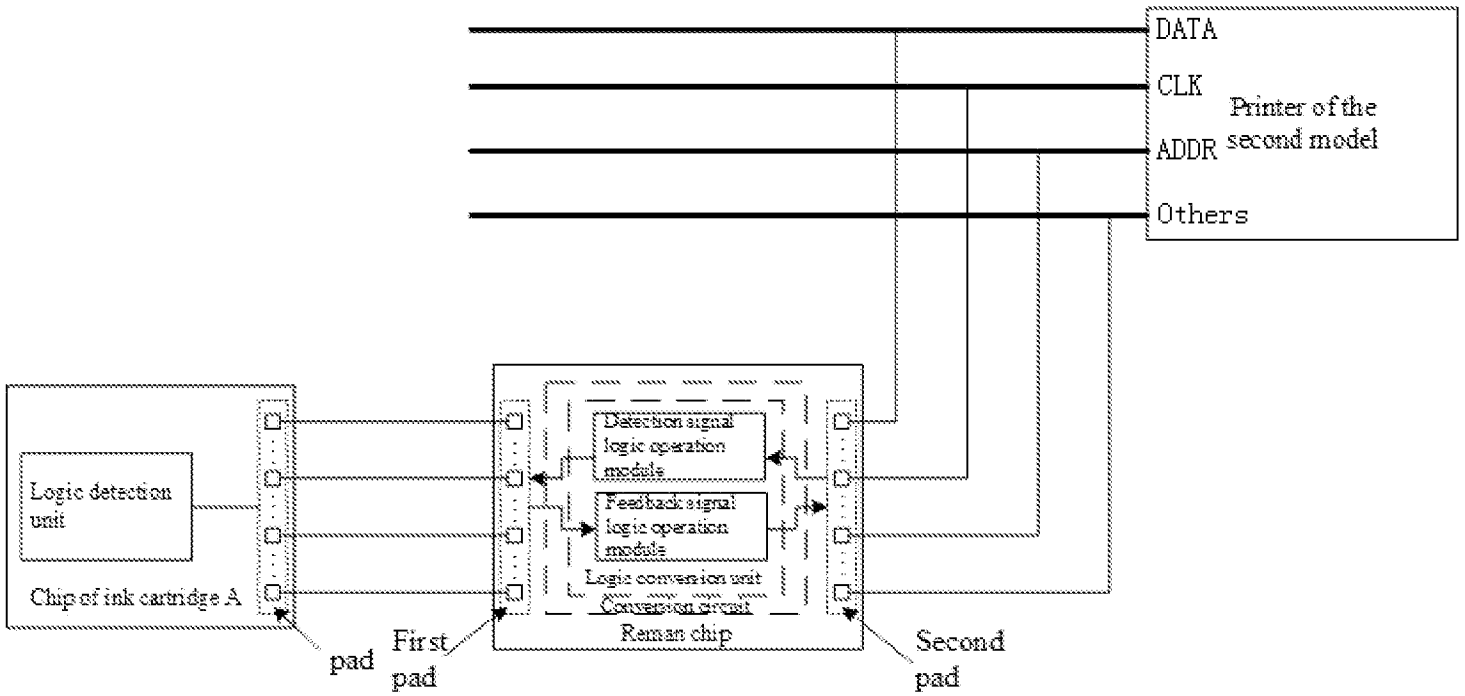
FIG. 11 is a connection schematic diagram of a logic conversion unit.

On this basis, as is shown in FIG. 11, the logic conversion unit of the reman chip is electrically connected with the second pads and the first pads. Specifically, the logic conversion unit comprises a detection signal logic operation module and a feedback signal logic operation module. The logic conversion unit receives a logic detection signal, from the second pads, of the printer of the second model, converts the logic detection signal of the printer of the second model into a corresponding logic detection signal, according to the logic detection rule (namely the formula 1) of the printer of the first model, of the printer of the first model through the detection signal logic operation module according to the formula 2 and outputs the logic detection signal of the printer of the first model through the first pads. The logic conversion unit receives a logic detection feedback signal, from the first pads, of the printer of the first model, converts the logic detection feedback signal of the printer of the first model into a corresponding logic detection feedback signal, according to the logic detection rule (namely the formula 2) of the printer of the second model, of the printer of the second model through the feedback signal logic operation module according to the formula 1 and outputs the logic detection feedback signal of the printer of the second model through the second pads. In this way, the reman ink cartridge can pass logic detection of the printer of the second model through the logic conversion unit.

For example, in the embodiment, after the electric signals on the signal lines P1, P2 and P3 of the printer of the second model are received through the second pads of the reman chip, logic AND operation is conducted on the electric signals on the signal lines P1, P2 and P3 through the detection signal logic operation module, and the operation result is sent to the chip pads P1 of the ink cartridge A through the first pads. The chip of the ink cartridge A receives the logic detection signal, converted and output by the logic conversion unit, of the printer of the first model through the first pads of the reman chip electrically connected with the chip of the ink cartridge A, obtains a logic detection feedback signal of the printer of the first model after logic operation is conducted according to the formula 1, and feeds back and outputs the logic detection feedback signal of the printer of the first model through the pads CHK of the ink cartridge A. However, the logic detection feedback signal of the printer of the first model is still different from a verification result required by logic detection of the printer of the second model. A logic detection feedback signal, meeting the logic detection requirements of the printer of the second model, of the printer of the second model is obtained by conducting logic inverse operation of the logic detection feedback through the feedback signal logic operation module and outputs to the printer of the second model trough the second pads of the reman chip, and thus logic detection of the printer of the second model is completed.

Figure 12:
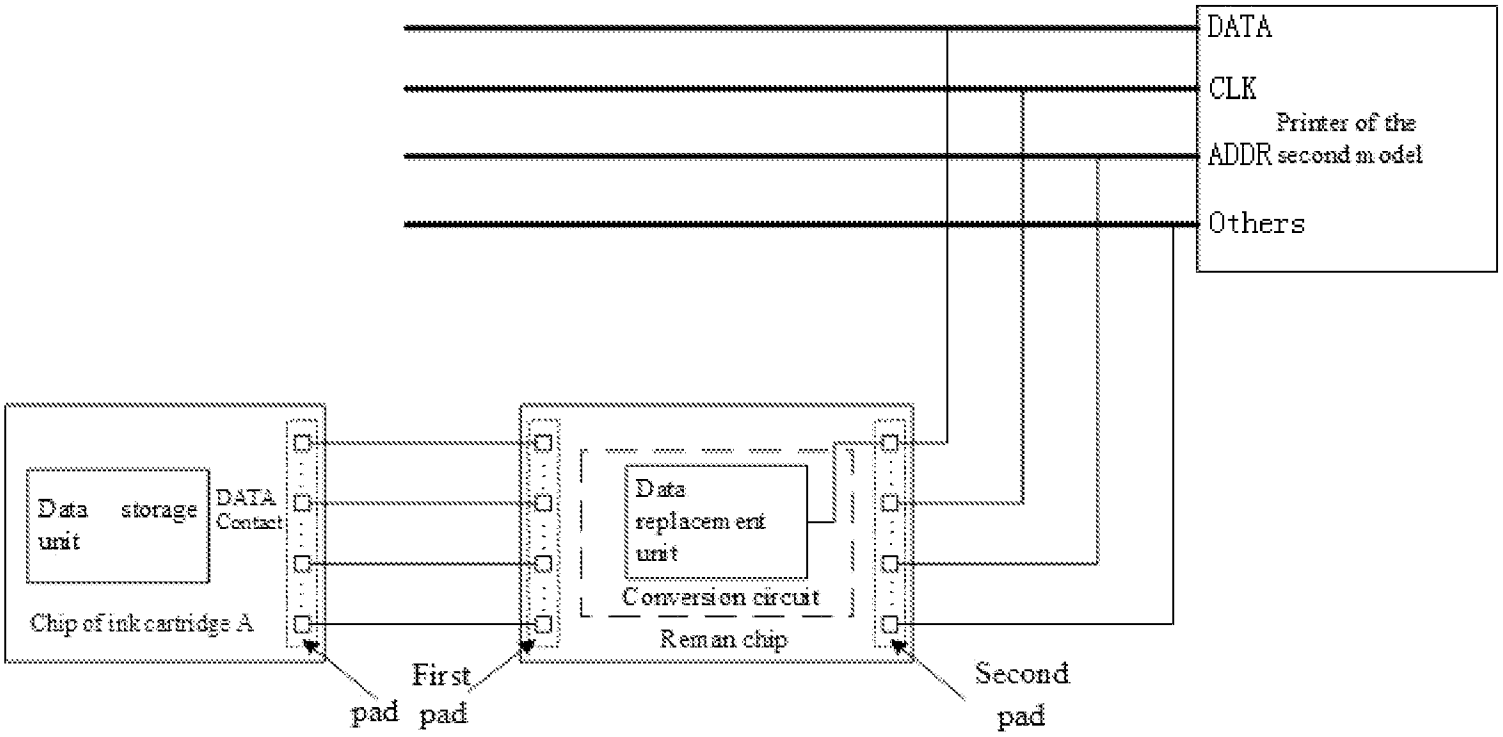
FIG. 12 is a connection schematic diagram of a data replacement unit.

A communication method of a printer system composed of the reman ink cartridge regenerated through the ink cartridge regeneration method and the printer of the second model comprises the steps that:

the reman chip modified or replaces ink quantity data and ink cartridge model data stored in the chip of the ink cartridge A to make the ink quantity data in the reman ink cartridge be non-ink-out data and make the ink cartridge model data of the reman ink cartridge be matched with those of the printer of the second model; wherein, the non-ink-out data indicate that the residual ink quantity of the ink cartridge is larger than the smallest ink quantity data allowed by the printer;

the reman chip receives a nozzle control signal, from the printer of the second model, of the printer of the second model, converts the nozzle control signal of the printer of the second model into a corresponding nozzle control signal, according to the nozzle control rule of the printer of the first model, of the printer of the first model and sends the nozzle control signal of the printer of the first model to the chip of the ink cartridge A.

the reman chip receives a logic detection signal, from the printer of the second model, of the printer of the second model, converts the logic detection signal of the printer of the second model into a corresponding logic detection signal, according to the logic detection rule of the printer of the first model, of the printer of the first model, and sends the logic detection signal of the printer of the first model to the chip of the ink cartridge A; the reman chip receives a logic detection feedback signal, from the original chip, of the printer of the first model, converts the logic detection feedback signal of the printer of the first model into a corresponding logic detection feedback signal, according to the logic detection rule of the printer of the second model, of the printer of the second model and sends the logic detection feedback signal of the printer of the second model to the printer of the second model Second Embodiment As is shown in FIG. 12, the data modification unit of the conversion circuit of the reman chip is correspondingly modified into a data replacement unit. The reman ink cartridge does not adopt the ink quantity data and the ink cartridge model data in the chip of the ink cartridge A. The data storage unit of the chip of the ink cartridge A is disconnected with the data line DATA of the printer. The data replacement unit of the reman chip is electrically connected with the printer of the second model through the second pads to replace the ink quantity data and the ink cartridge model data stored in the chip of the ink cartridge A, and thus the reman ink cartridge can pass authentication of the printer of the second model.

Third Embodiment

Figure 13:
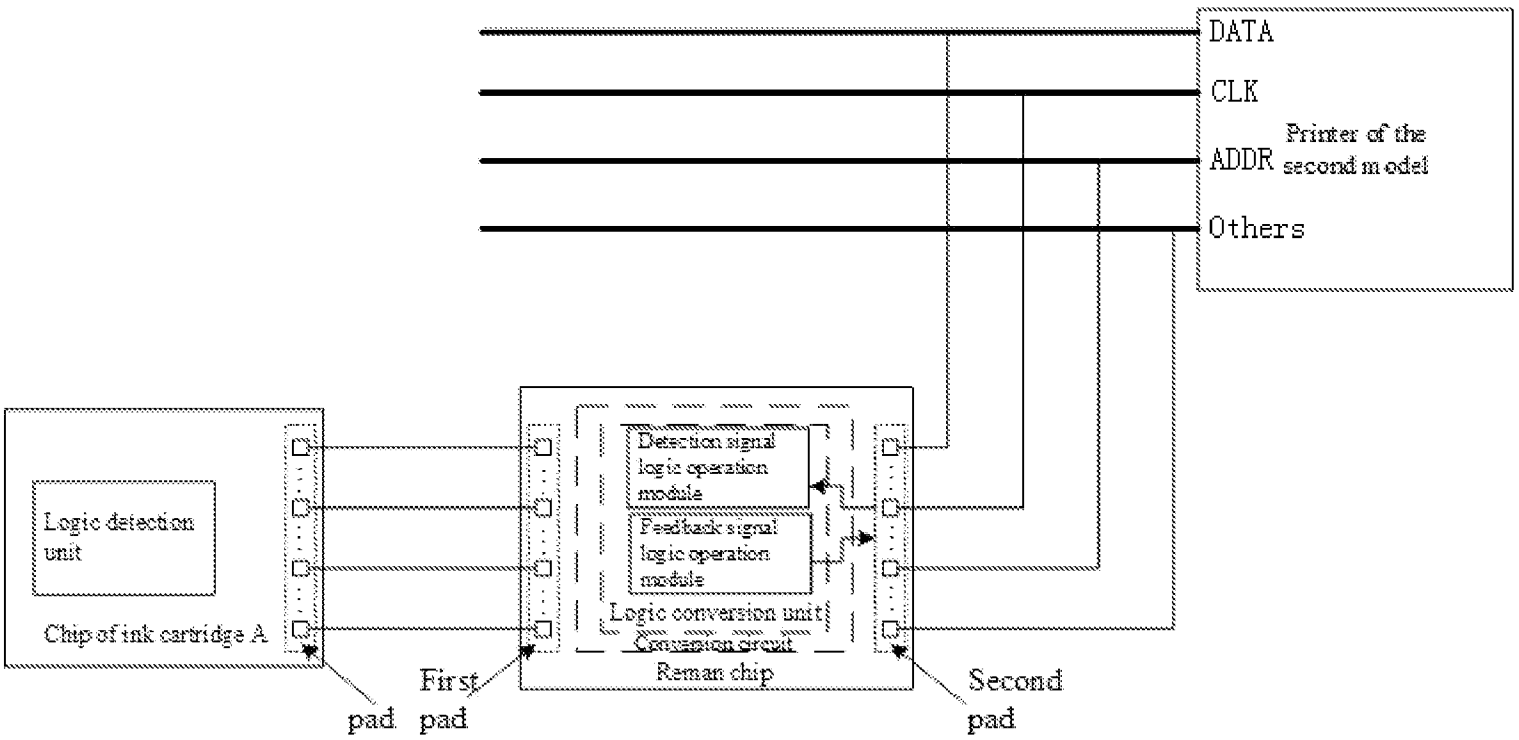
FIG. 13 is another connection schematic diagram of another logic conversion unit.

As is shown in FIG. 13, the chip of the ink cartridge A is not adopted by the reman ink cartridge for logic detection of the chip of the ink cartridge A. A logic detection unit of the chip of the ink cartridge A is disconnected with relevant signal lines of the printer. The logic conversion unit of the reman chip is electrically connected with the printer of the second model and directly replaces the logic detection unit, and thus the reman ink cartridge can pass logic detection of the printer of the second model.

The foregoing embodiments are only used for describing preferred execution modes of the present disclosure, but not used for limiting the concept and scope of the present disclosure. Various transformations and improvements made by those skilled in the field according to the technical scheme of the present disclosure without deviating from the concept of the present disclosure are all within the protection scope of the present disclosure, and the technical content required to be protected of the present disclosure are all recorded in the claims.

What is claimed is:

1. A reman chip, used for regenerating a reman ink cartridge matched with a printer of a second model from an original ink cartridge matched with a printer of a first model, comprising:

second pads;

first pads; and a conversion circuit which is electrically connected with the second pads and the first pads, wherein the second pads are used for being electrically connected with the printer of the second model;

the first pads are used for being electrically connected with an original chip of the original ink cartridge;

the conversion circuit receives electric signals from the second pads; and the first pads to make the reman ink cartridge pass authentication detection of the printer of the second model and respond to control of the printer of the second model.

2. The reman chip according to claim 1, wherein the conversion circuit comprises a data replacement unit and a logic conversion unit;

the data replacement unit is used for replacing the ink quantity data and ink cartridge model data stored in the original chip to make reman ink cartridge pass authentication of the printer of the second model, and the data replacement unit is electrically connected with the second pads; and the logic conversion unit is electrically connected with the second pads and also electrically connected with the first pads, makes the Reman ink cartridge to pass logic detection of the printer of the second model.

3. The reman chip according to claim 2, wherein the conversion circuit comprises a nozzle signal conversion unit; and the nozzle signal conversion unit is electrically connected with the second pads and also electrically connected with the first pads; and the nozzle signal conversion unit receives a nozzle control signal, from the second pads, of the printer of the second model, converts the nozzle control signal of the printer of the second model into a corresponding nozzle control signal, according to the nozzle control rule of the printer of the first model, of the printer of the first model and outputs the nozzle control signal of the printer of the first model through the first pads.

4. The reman chip according to claim 3, wherein the conversion circuit comprises an electric parameter adjustment unit which is used for adjusting the electric parameter of the original chip to make the reman ink cartridge pass electric parameter detection of the printer of the second model, and the electric parameter adjustment circuit is electrically connected with the first pads.

5. The reman chip according to claim 4, wherein the reman chip is provided with a substrate used for carrying the conversion circuit, and an adhesive film layer fixedly connected with the ink cartridge body is arranged on one side of the substrate.

6. The reman chip according to claim 5, wherein the substrate is provided with positioning holes used for positioning the ink cartridge body; and the substrate is provided with test pads, and the test pads are electrically connected with the conversion circuit.

* * * * *